US005407250A

United States Patent [19]

Prince et al.

[11] Patent Number: 5,407,250

[45] Date of Patent: Apr. 18, 1995

[54] MODULAR KNOCKDOWN CHAIR

[75] Inventors: James B. Prince, Pawleys Island, S.C.; R. A. Phillips, III; Hodge Kitchin, both of Scotland Neck, N.C.

[73] Assignee: Pawleys Island Hammock Co., Ltd., Pawleys Island, S.C.

[21] Appl. No.: 77,113

[22] Filed: Jun. 16, 1993

[51] Int. Cl.[6] ..... A47C 5/10

[52] U.S. Cl. ..... 297/440.2; 297/440.22; 297/440.23

[58] Field of Search ..... 297/440.1, 440.2, 440.22, 297/440.23, 258

[56] References Cited

U.S. PATENT DOCUMENTS

| | | | |
|---|---|---|---|
| 233,478 | 10/1880 | Creager . | |
| D. 299,087 | 12/1988 | Bruce . | |
| D. 313,320 | 1/1991 | Fisher . | |
| 655,488 | 8/1900 | Hayes . | |
| 693,197 | 2/1902 | White . | |
| 1,718,321 | 6/1929 | Vericel | 297/440.22 X |
| 3,663,059 | 5/1972 | Omlie | 297/440.20 |
| 3,727,981 | 4/1973 | Ostroff et al. . | |
| 3,909,064 | 9/1975 | Payne, Jr. et al. . | |
| 4,348,052 | 9/1982 | Roland . | |
| 4,419,028 | 12/1983 | Roland . | |
| 4,509,794 | 4/1985 | Roland . | |
| 4,588,227 | 5/1986 | Austin | 297/440.23 X |
| 4,919,485 | 4/1990 | Guichon . | |

FOREIGN PATENT DOCUMENTS

| | | | |
|---|---|---|---|
| 205706 | 10/1959 | Austria | 297/440.2 |
| 90311 | 12/1922 | Germany . | |
| 365461 | 12/1922 | Germany . | |
| 806110 | 12/1958 | United Kingdom | 297/440.23 |
| 1508585 | 4/1978 | United Kingdom | 297/440.2 |

*Primary Examiner*—Richard E. Gluck

*Attorney, Agent, or Firm*—Pollock, Vande Sande & Priddy

[57] ABSTRACT

A modular chair with quickly assembled and disassembled modules and a compact packing arrangement includes right and left side modules each having an arm member, a rocker member, at least one side member, at least one front mortise, at least one rear mortise, at least one back mortise, and front and rear posts connecting together the arm, side and rocker members. A back module has upper and lower stretcher members connected together by at least one back member, and right and left back tenons for engaging respectively the back mortises of the right and left side modules. At least one front rail connects together the front posts of the right and left side modules, and has right and left tenons for engaging respectively the front mortises of the right and left side modules. At least one rear rail connects together the rear posts of the right and left side modules, and has right and left tenons for engaging respectively the rear mortises of the right and left side modules. A seat module has front and rear support members connected together by at least one seat member, and corresponding end portions of the support members are adapted to rest on the side members of the right and left side modules.

7 Claims, 4 Drawing Sheets

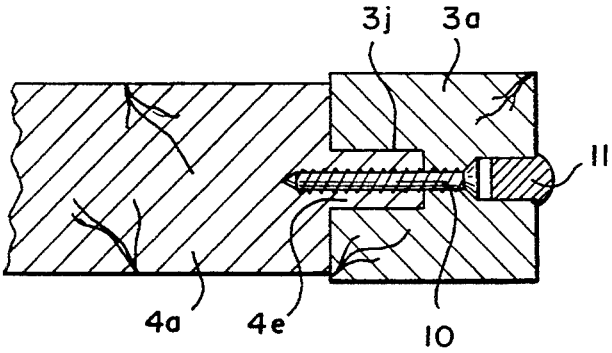
FIG. 5
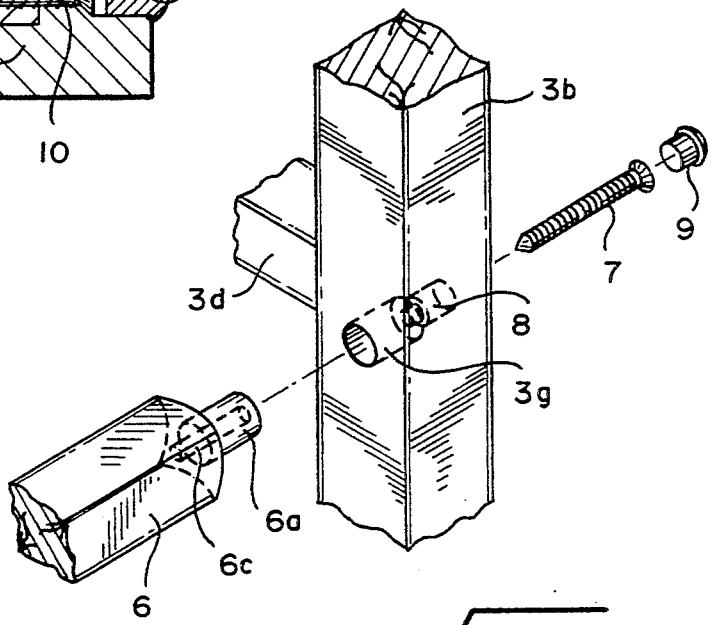
FIG. 7
FIG. 6
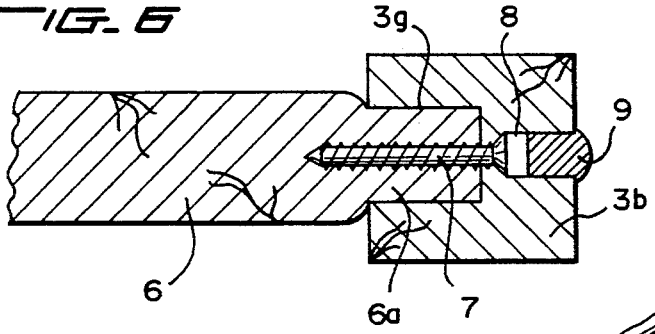
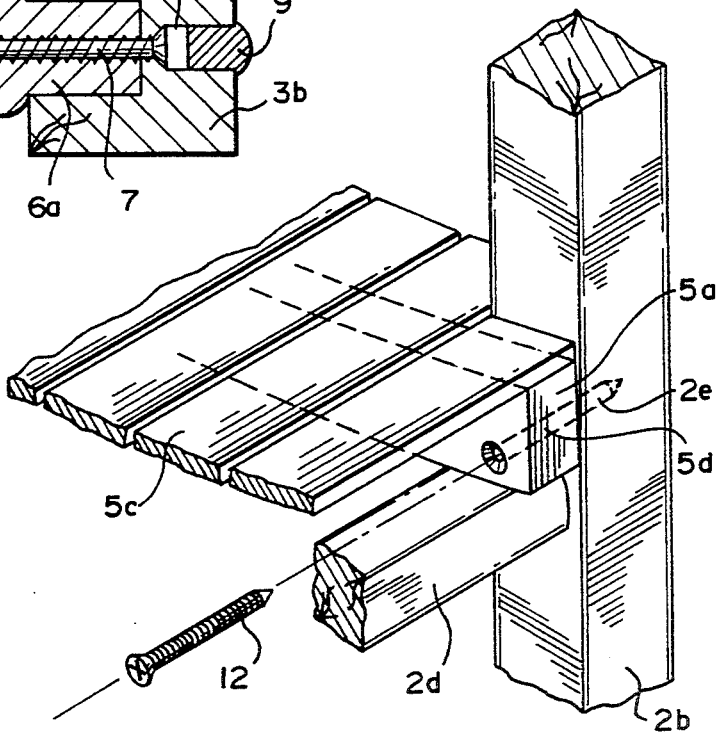
FIG. 8

MODULAR KNOCKDOWN CHAIR

FIELD OF THE INVENTION

The present invention relates to the field of furniture, and in particular, a knockdown chair including a number of modules which can be easily assembled and disassembled and which may be easily placed in a compact box for storage, transportation and/or packaging.

BACKGROUND OF THE INVENTION

The concept of producing furniture which is easily assembled by the purchaser has become increasingly popular. Such knockdown furniture provides a manufacturer with the opportunity to make high quality furniture available to customers at a lower cost, increases the ease with which furniture may be shipped, and also provides an opportunity for consumers to engage in a handicraft project to some extent. In addition, such knockdown furniture that may be both assembled and disassembled easily is much more adaptable than other types of furniture to the mobile lifestyle typical in society today. Although knockdown furniture is generally known, few pieces of such furniture are designed for both easy assembly and disassembly.

In constructing knockdown furniture, it is desirable that the piece of furniture be assembled from a plurality of relatively planar parts. For instance, a knockdown bureau may consist of a top, bottom, sides and back. The bureau drawers may include four sides and a bottom. All of these parts may be packaged in a flat, small container as compared to a container designed to hold the constructed bureau.

It is also desirable that the respective parts of knockdown furniture be designed for assembly and disassembly using standard household tools. Therefore, knockdown furniture packages often include fasteners, such as screws or bolts, to secure together the respective parts of the knockdown furniture. While these fasteners are necessary to allow the furniture to be assembled by the consumer, such fastening means would not normally be used if the furniture were constructed at a factory and shipped fully assembled.

SUMMARY OF THE INVENTION

The present invention provides an improved design for a knockdown chair, particularly a rocking chair, and utilizes a number of quickly assembled and disassembled modules. The chair includes right and left side modules each having an arm member, a rocker member, preferably at least one side member, front mortise means, back mortise means, and front and rear posts connecting the arm, side, and rocker members. The chair also includes a back module having upper and lower stretcher members connected together by at least one back member. The back module also includes right and left back tenon means for engaging respectively the back mortise means of the right and left side modules.

At least one front rail is provided for connecting the front posts of the right and left side modules. The front rail has right and left tenon means for engaging, respectively, the front mortise means of the right and left side modules. The chair preferably also includes at least one rear rail for connecting together the rear posts of the right and left side modules. The rear rail has right and left tenon means for engaging respectively corresponding rear mortise means of the right and left side modules. The front and rear rails, the respective side members and the front and rear posts may have various cross-sectional shapes, including square, rectangular, triangular, oval and round.

The chair further includes a seat module having front and rear support members connected together by at least one seat member. Corresponding end portions of the support members are adapted to rest on the side members of the right and left side modules when the back mortise of the side modules are engaged by the right and left tenon means of the back module and the front and rear mortise means of the side modules are engaged by the right and left tenon means of the front and rear rails respectively.

Additionally, the right end portion of the front support member of the seat module is preferably in close proximity to the front post of the right side module, the right end portion of the rear support member is preferably in close proximity to the rear post of the right side module, the left end portion of the front support is preferably in close proximity to the front post of the left side member and the left end portion of the rear support member is preferably in close proximity to the rear post of the left side module. Accordingly, the front, the rear or both seat support members may be connected directly to the corresponding front and rear posts of the side modules. If connected to both, the at least one side member may be omitted. However, there are preferably three side members, together with three front rails and two rear rails.

The present invention further provides a method of arranging the various modules and other components in a compact packing position providing a relatively thin and flat package which has a shipping volume substantially less than that of the assembled chair.

The present invention also provides a method of assembling a knockdown chair, including the step of laying one of the side modules on a supportive surface such that the various mortise means face upward. Next, the corresponding tenon means on the back member, on the at least one front rail and on the at least one back rail are inserted into the respective mortise means on this side module. Then, the respective mortise means on the other side module are aligned with the corresponding tenon means on the back module, on the front rail, and on the rear rail. All of the mortise and tenon means are then caused to become at least partially engaged by forcing the side modules toward each other, such as by applying weight or blows with a rubber mallet to the upper side module.

Securing screws or nails may then be inserted through the front and rear posts of the side modules and partially into the respective tenon means on the back module, on the at least one front rail, and on the at least one rear rail. Countersunk bores are preferably provided for the screwheads, and pre-drilled holes may be provided for the threaded screw shafts. A glue or adhesive composition for bonding together pieces of wood may be used instead of screws or nails.

After stabilizing the chair with the partially inserted securing screws or nails, the seat module is inserted into a space defined by the arm members, the side members, the front posts and the rear posts of said side modules. With the seat module in this position, the right and left end portions of the front and rear support members of the seat module will rest upon the side member of the right and left side modules, respectively.

Finally, after placing the seat module in position, the screws or nails inserted partially into the tenon means of the front rail, rear rail and back module are fully inserted to fully seat each tenon means in its corresponding mortise. With these screws or nails fully inserted, the size and shape of the seat module are preferably such that the otherwise unsecured seat module is not removable from the chair assembly. However, the seat module may be connected to either pair or both pairs of front and rear posts as previously indicated.

BRIEF DESCRIPTION OF THE DRAWINGS

The invention may be further understood from the Detailed Description thereof taken in conjunction with the accompanying drawings in which:

FIG. 5 is a cross-sectional view of the tenon and mortise connection of FIG. 4 taken along the line 5—5 in FIG. 2;

FIG. 6 is a cross-sectional view of a tenon and mortise connection for a front rail taken along the line 6—6 in FIG. 2;

FIG. 7 is an exploded perspective and fragmentary view of the joint shown in cross section in FIG. 6; and FIG. 8 is an exploded perspective and fragmentary view of a fixed connection between the seat module and one of the side modules of the embodiment of FIG. 1.

DETAILED DESCRIPTION OF THE INVENTION

Figure 1:
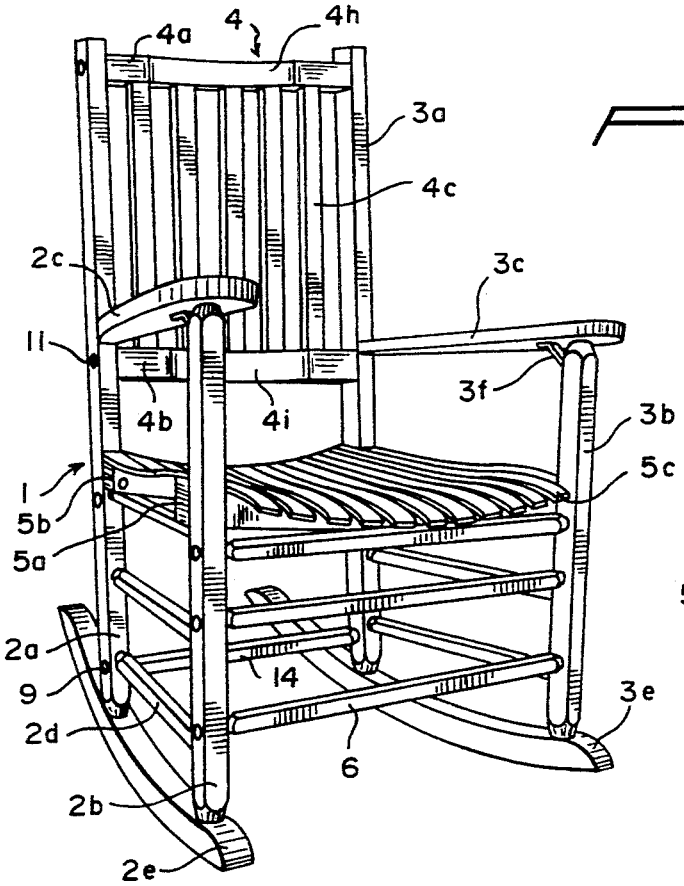
FIG. 1 is a perspective view of a fully assembled modular rocking chair according to one embodiment of the present invention.
Figure 2:
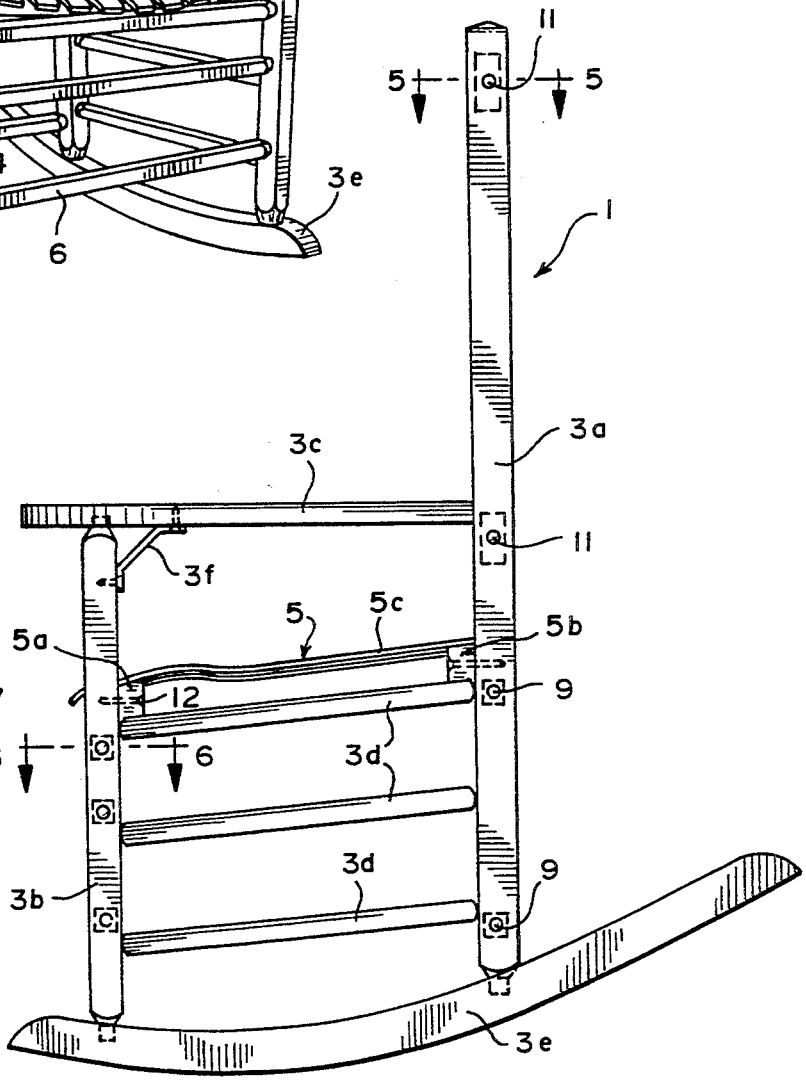
FIG. 2 is a side elevational view of the embodiment seen in FIG. 1.

FIG. 1 shows a preferred embodiment of a modular rocking chair according to the present invention. FIG. 2 shows a left side view of the embodiment shown in FIG. 1. The chair shown in FIGS. 1 and 2 is one example of a modular, knockdown chair which is made in accordance with the teachings of the present invention. Different types of knockdown chairs, other than rocking chairs, also may be made in accordance with the present invention.

Figure 3:
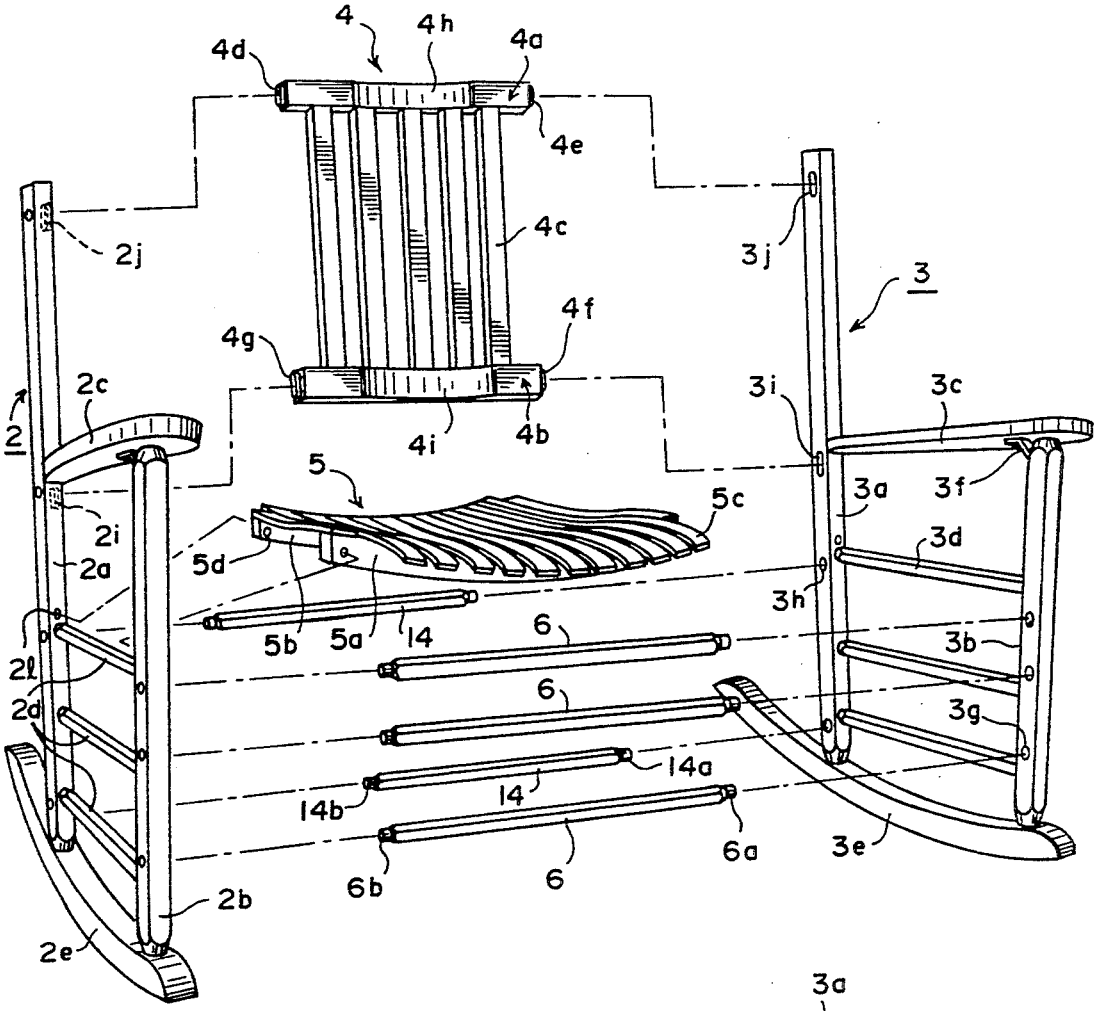
FIG. 3 is an exploded view of all of the components of an assembled modular rocking chair according to the embodiment of FIG. 1.

The rocking chair, according to the embodiment shown in FIGS. 1 and 2, includes a set of quickly assembled and disassembled modules as seen in the exploded view in FIG. 3. These modules include right and left side modules 2 and 3, respectively, a back module 4 and a seat module 5. Each of these modules may be made up of a plurality of components.

For instance, the right and left side modules 2 and 3 as seen in FIG. 3 may include respectively upright rear post members 2*a* and 3*a* extending from the floor to the top of the back at the rear of the chair. Upright front post members 2*b* and 3*b* may extend from the ground to the corresponding arm members 2*c* and 3*c*. The arm members 2*c* and 3*c* may extend from a point near the middle of the upright rear post members 2*a* and 3*a* and may be connected to the top of the upright front post members 2*b* and 3*b*.

At least one side member 2*d*, 3*d* may be attached to both the upright rear post member 2*a*, 3*a* and the upright front post member 2*b*, 3*b* to provide increased structural integrity to the chair and to support the seat module as described below. The embodiment shown in FIG. 3 includes three such side members for each of the side modules 2 and 3. However, a smaller or larger number of side members may be included in a chair according to the present invention.

If the chair is a rocking chair, each of the side modules also includes a rocker member 2*e*, 3*e* attached to the base of the upright rear post member 2*a*, 3*a* and to the base of the upright front post member 2*b*, 3*b*.

Since the side modules are the same, any part discussed as being on one side module is to be understood as having a corresponding part on the other, although not all parts on each side module are specifically discussed with reference to a part number.

Although the components of the side modules may be connected together using a variety of joint types, mortise and tenon joints are used in the embodiment shown in FIGS. 1–3. The mortise and tenon joints may be supplemented by the use of a bracket 2*f*, 3*f* secured to the upright front post and to the arm member 2*c*, 3*c* as well. As best seen in FIG. 2, the bracket may be secured to the arm member and front post using screws. The mortises and tenons may be secured together by a variety of securing means, including glue, screws or nails. Glue is preferably used to secure together all of the mortises and tenons providing joints between the components of the right and left side modules.

The upright rear and front post members of the side modules 2 and 3 each include a plurality of connecting means for engaging the cross-connecting rail members 6 and 14 and the back module 4 making up the chair. In the embodiment shown in FIGS. 1–3, these cross-connecting means on the right and left side modules are mortise means, such as 3*g* on the inside of the front post 3*b* of the left side module 3 facing the right side module 2, 3*h* on the lower portion of the rear post 3*a* of the left side module and 3*i* and 3*j* on the upper portion of the back rear post 3*a* of the left side module. The right side module 2 has mortise means in the same number and location as the left side module, but they cannot be seen in FIG. 3.

The mortise means 3*g* and 3*h* in the embodiment shown in FIG. 3 have circular cross sections. However, other shapes may be used for these mortise means, such as square, oblong, or other structural shapes. The mortise means 3*i* and 3*j* formed in the upper portions of the rear posts 2*a* and 3*a* are provided for connecting the side modules 2 and 3 to the back module 4 and are preferably in the shape of an elongated ellipse or an oval. As discussed regarding the other mortise means included on the side modules, the mortise means for connecting the back module and the side modules may have other shapes, such as round, square, rectangular, oblong and the like. Each side module includes the same number and location of mortise means and each side of the back module includes corresponding tenon means. Therefore, the discussion of the mortise and tenon means applies to both side modules and either side of the back module.

Inserted between and connected to the left and right side modules are the back module 4, a seat module 5, at least one front rail 6 and at least one rear rail 14. As seen in FIGS. 1–3, three front rails 6 connect together the front upright posts of the left and right side modules. Each front rail includes right and left tenon means **6*b* and 6*a* for engaging the mortise means 2*g* and 3*g*** on the right and left side modules respectively. The tenon means must have the same cross-sectional shape and slightly less cross-sectional area as the corresponding mortise means into which it will be inserted.

When assembling a modular chair according to the present invention, the at least one front rail may be secured in place solely by the friction between the mortise means and tenon means, However, it is preferable that the at least one front rail be secured to the right and left side modules using screws to provide greater structural integrity. In addition, where no future knockdown capability is desired, glue may be placed within the mortise means on the front post members to further secure the front rail(s).

As seen in closeup cross section in FIG. 6, the tenon means **6*a* on the at least one front rail 6 fits into the at least one mortise means 3*g* on the upright front post 3*b* of the left side module 3. A screw 7 engages a hole 8, which may be pre-drilled, in the side of the upright front post member. The screw preferably extends through the upright front post member 3*b*, through the tenon means 6*a* and at least partially into the body of the at least one front rail 6. The hole 8 may then be sealed with a sealing member 9 to protect the hole and the screw. The sealing plug member 9 may be glued in place and is more aesthetically pleasing than the open hole 8 and the exposed screw 7. FIG. 7 shows a perspective fragmentary view of the joint shown in cross section in FIG. 6, and illustrates the spatial relationship between the various components of the joint. The joint between the right tenon means 6*b* on the front rail(s) is joined to a similar mortise means on the right front post 2*b* on the right side module 2. The at least one rear rail 14 also includes tenon means to fit into corresponding mortise means in the inside face of the lower portion of the rear posts 2*a* and 3*a* respectively of the right and left side modules 2 and 3**. The rear rail(s) may be attached to the rear posts in the same manner as the front rail(s).

In addition to the front and rear rails, the right and left side modules are connected by the back module 4. The back module includes an upper stretcher member **4*a* and a lower stretcher member 4*b*. As seen in FIGS. 1 and 3, the stretcher members may be elongated members with a substantially rectangular cross section. Depressions 4*h* and 4*i*, which conform generally to the lateral curvature of a person's back, may be formed in the upper and lower stretcher members respectively and face the front of the chair to provide a more comfortable back rest. The upper and lower stretcher members are connected by at least one back member 4*c*, which also may be curved or warped vertically to conform generally to the vertical curvature of a person's back. The embodiment shown in FIGS. 1–3** includes five back members. However, a greater or lesser number of back members may be included in the back module. The back members may be joined to the upper and lower members using mortise and tenon joints, preferably with the mortises and tenons glued together, or any other suitable means for fixing two pieces of wood together in such an arrangement.

To connect the back module to the side modules, the ends of the upper and lower stretcher members may be provided with right and left back tenon means **4*d*, 4*e*, 4*f*, and 4*g*. These back tenon means engage the back mortise means 2*i*, 2*j*, 3*i*, and 3*j* in the upper portion of the rear post members 2*a* and 3*a*** of the right and left side modules. The mortise and tenon means on the back module and the rear posts of the side modules must have the same shape and the cross-sectional area of the tenon means must be slightly less than the cross-sectional area of the corresponding mortise means. The back mortise means on the rear posts of the right and left side modules are formed on the side modules at a distance from each other as necessary to accommodate a back module having back members of a selected length. Since the length of the back members may be varied, the distance between the upper and lower stretcher members of the back module will vary accordingly, thereby necessitating a corresponding change in the location of the mortise means on the back posts of the side modules.

Figure 4:
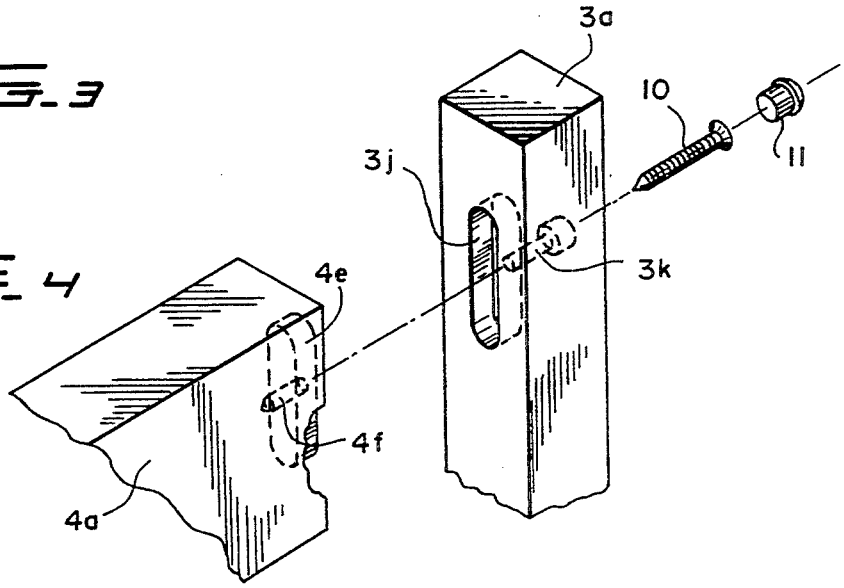
FIG. 4 is an exploded perspective and fragmentary view of one of the tenon and mortise connections between the back module and one of the side modules of the embodiment of FIG. 1.

FIG. 4 shows an exploded perspective and fragmentary view of the joint between the back module 4 and the left side module 3. As seen in FIG. 4, the tenon **4*e* on the upper stretcher member 4*a* of the back module 4 fits into the tenon means 3*j* on the back post 3*a* of the left side module 3. The upper stretcher member 4*a* and the tenon means 4*e* of the back module 4 may include a pre-drilled hole 4*f* which extends through the tenon means and at least partially into the body of the upper stretcher member 4*a*. This pre-drilled hole is adapted to receive a screw 10** of predetermined size.

The back post **3*a* of the left side module 3 may also include a pre-drilled hole 3*k* for receiving the screw. After the mortise 4*e* is inserted into the tenon means 3*j*, the screw 10 is screwed onto the hole in the back post and into the tenon 4*e* and stretcher member 4*a*. The end of the hole 3*k* may then be closed with a decorative button 11. FIG. 5 shows a cross-sectional view of the joint between the back module 4 and the side modules 3. The other 3** joints between the back module and the right and left side modules are similarly constructed.

Also located between the right and left side modules is a seat module 5. The seat module, as seen in perspective view in FIG. 3, includes front and rear support members **5*a* and 5*b* which preferably are substantially parallel to each other. At least one seat member 5*c* connects together the front and rear support members 5*a* and 5*b*, respectively. The embodiment shown in FIGS. 1–3 includes 13 seat members, although a greater or lesser number may be included. At either side of the seat module, there is preferably provided a shorter seat member 5*e* of a length adapted to fit longitudinally between the front and rear posts of the side modules 2 and 3 as seen best in FIGS. 3 and 8**.

The front and rear support members **5*a* and 5*b* of the seat module 5 must be sufficiently long so as to be able to rest upon the side members 2*d* and 3*d* of the right and left side modules when the back module 4 and front rail(s) 6 and rear rail(s) 14 connect the two side modules together. The distance between the front and rear support members 5*a* and 5*b*** is sufficient so that with the seat inserted between the right and left side modules, the front and rear support member of the seat module are in close proximity to the front and rear posts of the right and left side modules.

The relationship between the front post member **2*b* of the right side module 2 and the front support member 5*a* of the seat module 5 may be seen in FIG. 8. With the tenon means fully seated in their corresponding mortise means so that the side modules are securely connected together by the back module and by the at least one front rail and the at least one rear rail, the seat module will be held loosely in place and removal thereof will be prevented by the arms, front and rear posts, and side members of the side modules. However, the seat module may be more securely fixed in position relative to the other components of the chair by using screws inserted into holes formed in the front and rear support members and into corresponding holes in the front and/or rear posts of the side modules. As seen in FIG. 8, the screw 12 is inserted into the hole 5***d* in the front support member 5*a* of the seat module and into the holes 2*e* formed in the front post 2*b* of the right side module 2.

So as to facilitate the securing of the screw in the seat module and in the front posts of the side modules, the holes 5*d* and 2*e* are preferably drilled so as to be angled from the outside of the chair towards the inside of the chair. As seen in FIG. 8, the hole 2*e* in the right front side post of the right side module should be angled slightly from right the left. The holes 5*d* and 2*e* need to be angled only sufficiently to allow a screw driver to be easily applied to the head of screw 12 as the latter enters into these holes. Otherwise, with the seat module resting on the side members, there may not be enough space between the seat members 5*c* of the seat module and side members 2*d* and 3*d* of the right and left side modules to accommodate a screw driver to screw in the screws. By angling the holes 5*d* and 2*e* running through the support members of the seat module and the front and/or rear posts of the side modules, a screw driver can be easily applied to secure the screws. The other connections, if any, between the seat module and the side modules may be formed in a manner similar to that discussed above and illustrated in FIG. 8.

Figure 9:
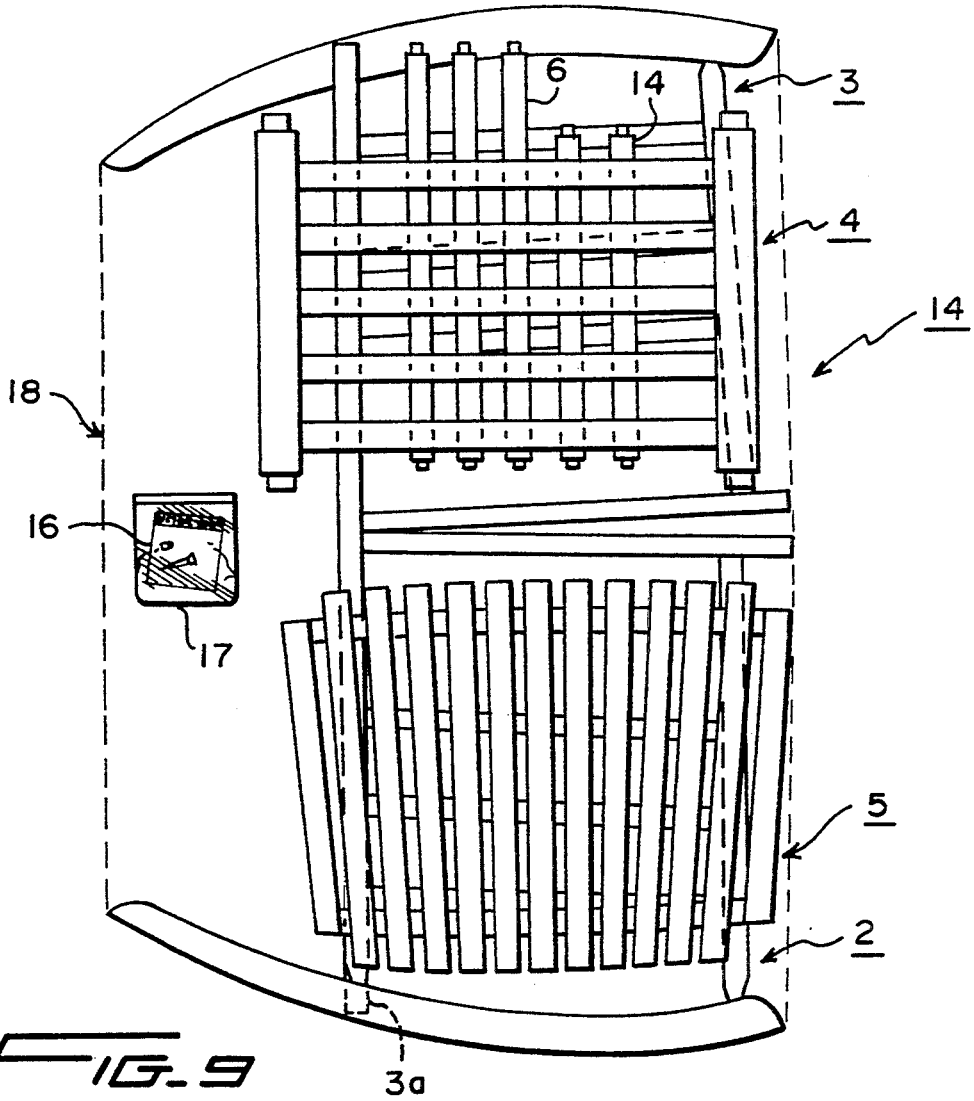
FIG. 9 is a plan view of a disassembled modular rocking chair showing all of the components of the embodiment of FIG. 1 in a packing arrangement.
Figure 10:
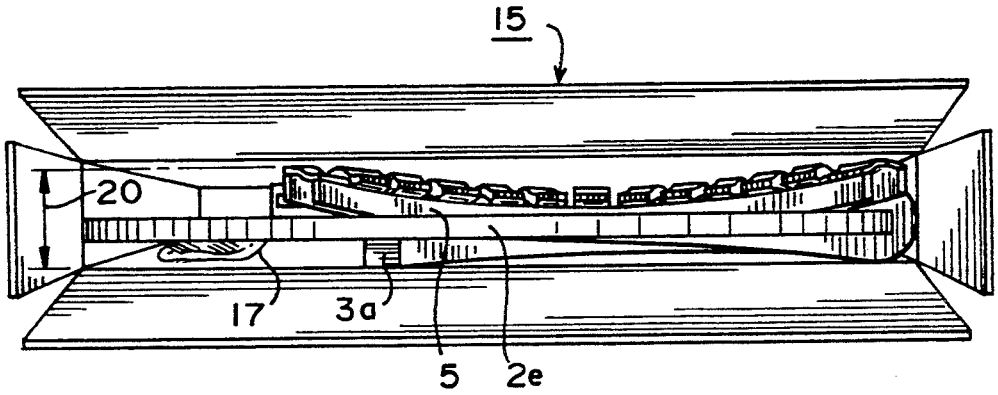
FIG. 10 is an end view of the packing arrangement of the disassembled chair in a shipping carton or similar container.

The present invention further includes a method of arranging the components of the modular chair and the resulting arrangement for packing in a flat container of relative small thickness as measured transverse to its length and width dimensions. With the chair disassembled, the modules and other components thereof are preferably arranged in a packing arrangement 14 as shown in FIG. 9 before being inserted in a cardboard carton 15 or other shipping container as shown in FIG. 10. To keep these components in the packing arrangement shown, the arranged components 14 are preferably wrapped several times with wide sheets of thin film plastic (not shown) drawn from a roll of this packaging material. The screws 7, 10 and 12, the plugs 9 and 11, and a sheet 16 of written assembly instructions, are preferably package in a sealed plastic bag 17 as shown in FIG. 9 and placed in carton 15 along with packing arrangement 14.

To achieve this packing arrangement, the right and left side modules 2 and 3 are laid flat in opposite directions with the rear post thereof overlapped substantially along their entire length as shown in FIG. 9. Then, the back module 4 is laid flat over the side member area of one of the flat side modules, and the seat module 5 is laid flat over the side member area of the other flat side module. The front and rear rails are then laid between back module 4 and the side members of the corresponding side module. The shape and size of the back, seat and side modules and of the front and rear rails are such that when laid flat they fit within the perimeter defined by the outline 18 of the side modules when viewed from the side. The packing arrangement also is such that the thickness thereof transverse to the height and depth of the side modules is substantially equal to the combined thicknesses of the seat module 5 and the rear posts 2*a* and 3*a* of the right and left side modules as shown in FIG. 10.

The present invention also includes a method of assembling a modular chair from the quickly assembled and disassembled modules of the invention. According to this method, a first one of the side modules is laid on a flat surface, with the mortise means on this side module facing upward. Either the right or left corresponding back tenon means on the back module are then inserted into the back mortise means on the first side module. Next, the tenon means on the at least one front rail and the at least one rear rail are inserted into the mortise means on the front and rear posts of the first side module. The back module and front and rear rails may then be gently tapped until the mortise and tenon joints are snug.

After placing the back module and the front and rear rails on the first side module, the second side module is placed on top of the free ends of the back module and the front and rear side rails so that the tenon means on the upper and lower stretcher members of the back module are inserted into the back mortise means, front mortise means, and rear mortise means, respectively, on the second side module. The second side module may then be tapped until the tenon means are secure in the mortise means thereof.

The chair is then placed in an upright position and screws or nails are partially inserted into the rails only enough to stabilize the chair. While the chair is so secured, but still lose, the seat module is inserted past the arms and into the space between the arms and side members of the side modules. The screws or nails securing the stretcher members of the back module and the front and rear rails are then fully inserted such that the tenon means are fully seated in the mortise means, the chair is sturdy, and the modules and rails are completely immobile relative to each other.

Wooden plugs may then be inserted into the screw or nail holes to cover the screw or nail heads and glued in place with a small amount of glue that would not prevent later removal of the plugs with a screw driver. At this point, screws or nails may be inserted through the support members of the seat module into the front and/or rear posts of the side modules and then fully tightened (screws) or seated (nails). However, in the preferred embodiment of the present invention, screws or nails are not required for securing the seat module because the size and shape of this module is such that it is not removable from the chair assembly, although it may be lifted off of the upper side members 2*d* and 3*d*. A notch may be provided in the ends of seat support members 5*a* and 5*b* as shown by the broken line 20 in FIG. 8 to prevent side to side shifting of the unsecured seat module.

The embodiments describe above represent nonlimiting examples of the invention and many other variations and modifications are possible without departing from the spirit and scope of the invention. Accordingly, the invention is not limited in its application to the details of structure specifically described or illustrated and, within the scope of the appended claims, it may be practiced otherwise than as specifically described or illustrated.

What is claimed is:

1. A modular chair with quickly assembled and disassembled modules, said chair comprising:

right and left side modules each having an arm member, at least one side member, front mortise means, rear mortise means, back mortise means, and front and rear posts connecting together said arm, and side members;

a back module having upper and lower stretcher members connected together by at least one back member, and right and left back tenon means for engaging respectively the back mortise means of said right and left side modules;

at least one front rail for connecting together the front posts of said right and left side modules, and having right and left tenon means for engaging respectively the front mortise means of said right and left side modules;

at least one rear rail for connecting together the rear posts of said right and left side modules, and having right and left tenon means for engaging respectively the rear mortise means of said right and left side modules; and, a seat module having front and rear support members connected together by at least one seat member, said support members being long enough to at least partially extend over one of the side members of each of said side modules such that each of said support members may rest on said one side member of both of said side modules when said chair is fully assembled, said at least one seat member being sufficiently long for said front and rear support members to be placed in the vicinity of said front and rear posts, respectively, and said seat module not being removeable while said chair is fully assembled.

2. A modular chair according to claim 1, wherein said chair is a rocking chair and said side members are rocker members.

3. A modular chair according to claim 1, wherein corresponding end portions of said support members are adapted to rest on the side member of each of said right and left side modules when the back mortise means of said side modules are engaged by the right and left tenon means of said back module and the front and rear mortise means of said side modules are engaged by the right and left tenon means of said front and rear rails, respectively.

4. The modular chair according to claim 1, wherein said tenon means on said at least one front rail and on said at least one back rail have a substantially circular cross section and the front and rear mortise means on said right and left side modules have a corresponding cross section.

5. The modular chair according to claim 1, wherein said tenon means on said upper and lower stretcher members have a substantially oval cross section and said mortise means on said rear posts of said side modules have a corresponding cross section.

6. The modular chair according to claim 1, wherein at least one securing element secures at least one of said support members of said seat module to at least one of said front and rear posts of said side modules.

7. The modular chair according to claim 6, wherein said securing element is a screw or nail and the longitudinal axis thereof is angled inward relative to said side members of said side modules.

* * * * *